US006148562A

United States Patent [19]

Stark et al.

[11] Patent Number: 6,148,562

[45] Date of Patent: Nov. 21, 2000

[54] SOUNDPROOF SPRING AND COVER FOR WINDOW JAMB LINERS

[75] Inventors: Ivan L. Stark, Ada, Mich.; James A. Hylton; James S. Hylton, both of Buchanan, Va.; Kim K. DeVormer, Middleville, Mich.; James W. Gibbs, Jr., Roanoke, Va.; Jack L. White, Troutville, Va.; Gerald A. Hedrick, Jr., Hardy, Va.

[73] Assignee: Newell Industrial Corporation, Roanoke, Va.

[21] Appl. No.: 09/143,171

[22] Filed: Aug. 28, 1998

Related U.S. Application Data

[60] Provisional application No. 60/057,274, Aug. 29, 1997.

[51] Int. Cl.[7] ..... E05F 1/00

[52] U.S. Cl. ..... 49/429

[58] Field of Search ..... 49/176, 181, 428, 49/414, 424, 429, 430, 436, 437, 438, 439, 445, 447, 448, 453, 454, 456, 457; 16/197, 199, DIG. 6

[56] References Cited

U.S. PATENT DOCUMENTS

| | | | |
|---|---|---|---|
| 3,078,523 | 2/1963 | Martin | 20/52 |
| 3,145,433 | 8/1964 | Jones | 20/52 |
| 3,290,825 | 12/1966 | Adams | 49/453 X |
| 4,779,380 | 10/1988 | Westfall | 49/430 |
| 4,854,558 | 8/1989 | Newton | 16/197 X |
| 5,033,235 | 7/1991 | Stark | 49/445 |
| 5,159,794 | 11/1992 | Habbersett et al. | 49/453 X |
| 5,203,546 | 4/1993 | Amadore | 16/197 X |
| 5,206,973 | 5/1993 | Belcher | 16/197 |
| 5,699,636 | 12/1997 | Stark | 49/419 |

*Primary Examiner*—Jerry Redman
*Attorney, Agent, or Firm*—Price, Heneveld, Cooper DeWitt & Litton

[57] ABSTRACT

An improved soundproofing system for a window sash mounted for sliding vertical movement between jambs of a window case includes first and second jamb liners which are mounted on opposite jambs of a window case, and which each define a vertically extending channel in which a coil spring is disposed with one end connected to the window case and with an opposite end connected to a sash which is vertically slidable between the jambs. At least one strip of sound-absorbent material such as felt is wrapped at least partially around and attached to each of the coil springs. Each of the vertically extending channels includes an open side which faces away from the jamb. A spring cover is connected to and closes a vertically extending portion of the open side of each of the vertically extending channels. The fabric strip wrapped around the springs, and the spring cover, together or separately substantially reduce objectionable noises generated by the springs. A second form of spring cover has one or more flexible fin walls extending laterally and along the length thereof through the open side of the channel and into contact with the spring therewithin, to damp out and reduce such spring noises even when the sound-absorbent material is not applied to the spring. Preferably this form of spring cover comprises a coextrusion formed from two different polymers.

9 Claims, 2 Drawing Sheets

SOUNDPROOF SPRING AND COVER FOR WINDOW JAMB LINERS

CROSS REFERENCE TO RELATED APPLICATION

The present application claims the benefit of U.S. Provisional Application Ser. No. 60/057,274, filed Aug. 29, 1997.

FIELD OF THE INVENTION

This invention relates to spring balance mechanisms for window sash slidably mounted for vertical movement between a pair of jamb liners on a window case, and more particularly to such mechanisms and windows having improved means for reducing objectionable noises which are typically generated by the spring balance mechanism as a window sash is raised or lowered to open or close the window.

BACKGROUND OF THE INVENTION

A window sash mounted for sliding vertical movement within a window case, also known as a double hung window, can require a significant force to raise the window. To equalize the required raising force with the force needed to lower the window, elongated metal coil springs generally disposed laterally adjacent to the opposing sides of the sash and within a vertical channel defined by jamb liners have been provided. One end of the spring is generally attached to a stationary part of the window case or jamb liner, and the other end of the spring is attached to the movable sash or, more typically, to a shoe or other sash support member slidably mounted within a vertical guideway defined by the jamb liners and/or the jambs. Such balance springs are designed or selected so that they urge the window sash upwardly with a force which is generally about equal to the weight of the sash. As a result, the frictional forces between the sash and jamb liners, or between the shoe or other sash support members and the vertical guideways can be minimized, so that both opening and closing the window can be accomplished with very little effort.

A problem with conventional spring balance mechanisms used to balance the weight of a window sash is that, as the window is raised or lowered, the spring vibrates. This vibration causes the sides of the metal spring to rapidly and repeatedly impact against the rigid plastic walls of the vertical channels in which the spring is disposed. Such interactions between the spring and the walls of the vertical channel often create an unpleasant and objectionable clattering or rattling noise.

Attempts to reduce or eliminate the noise caused by vibrating springs have traditionally been limited to attaching flocking to the springs. This involves applying an adhesive to the spring and covering it with tufts of fiber. The flocked springs, however, do not sufficiently reduce the level of noise generated as the sash is raised or lowered. In particular, many people regard the noise generated by flocked springs to be almost as objectionable as the noise generated by a spring which has not been flocked. Further, any reduction achieved by flocking the spring is degraded over time with continued use of the window, since tufts of fiber are gradually removed from the spring by the repeated vibrational interactions between the spring and the walls of the channel in which it is disposed. Of course, the use of flocked springs adds to the cost of the spring balance mechanism and hence to the cost of the window. While it has been proposed to use strips of soft plastic or the like inside the narrow and often restricted guideways in order to provide a bumper between the spring and hard plastic walls of the guideways, that approach involves manufacturing complexity and difficulty, with significant and potentially undue additional expense.

SUMMARY OF THE INVENTION

This invention concerns an improved soundproofing or sound dampening system for a window sash mounted for sliding vertical movement between jambs of a window case, which more effectively reduces or eliminates objectionable noises generated by a spring balance mechanism as the window is raised or lowered. The soundproofing system is relatively simple in design and does not require any expensive equipment for installation.

The system provided herewith is generally intended for use in window installations having first and second jamb liners which are mounted on opposite jambs of a window case, and which each define a vertically extending channel in which a coil spring is disposed, with one end of the spring connected to the window case, and with an opposite end connected to a sash which is vertically slidable between the jambs. In a first embodiment, at least one strip of sound-absorbent fabric is wrapped around and attached to radially outwardly facing surfaces of each of the coil springs. Each of the vertically extending channels includes an open side which faces away from the jamb, i.e., toward the window opening and sash. A spring cover is connected to, and closes, a vertically extending portion of the open side of each of the vertically extending channels. The fabric strips wrapped around the springs and the spring cover each significantly reduce objectionable noises generated by the springs, and when used together provide a very marked improvement.

In accordance with another aspect of the invention, a vibration-damping spring cover is connected to, and closes, a vertically extending slot-like opening in each of the vertically extending channels of jamb liners mounted on opposite jambs of a window case. The spring cover includes at least one vertically extending flexible wall portion which projects into the vertically extending channel in which the coil spring is disposed, to engage radially outwardly facing surfaces of the coil spring. Engagement between the flexible wall of the cover and the coil spring significantly reduces and damps spring vibrations to effectively reduce or eliminate noises generated by the spring when a sash balanced by the coil spring is raised or lowered to open or close the window. The spring cover can be used alone, or in combination with the above-described strips which are wrapped around the springs, to reduce or eliminate objectionable noises generated by the springs.

DESCRIPTION OF THE PREFERRED EMBODIMENTS

Figure 1:
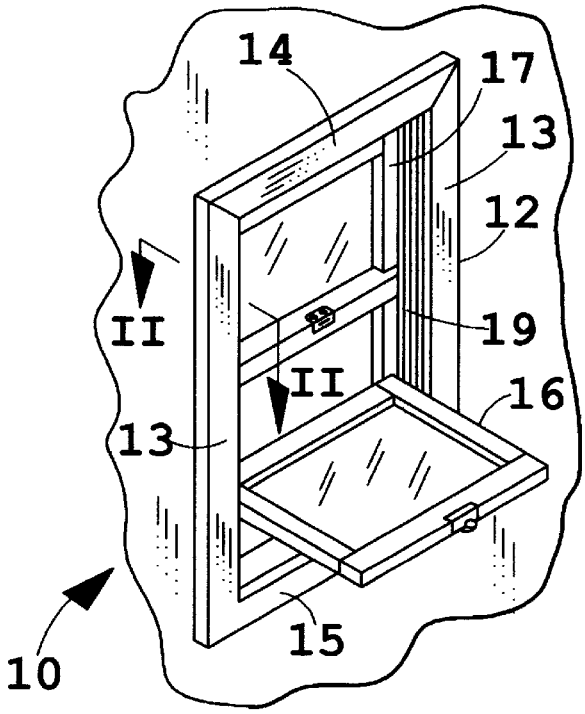
FIG. 1 is a perspective view of a window of the type in which the soundproofing system of this invention may be utilized.

Shown in FIG. 1 is a window 10 including a frame defined by jambs 12 and 13, top horizontal member 14 and bottom horizontal member 15. Window 10 also includes a sash 16 which is mounted for sliding movement within a vertical plane between the jambs 12 and 13. Sash 16 may be pivotable out of the plane of the window opening as shown in FIG. 1. However, the soundproofing system of the invention may be employed in generally any window having a sash mounted for sliding vertical movement between jambs of the window case or frame employing a spring balance mechanism. Upper sash 17 may be movable or stationary and may, or may not, be pivotable from the plane of the window opening.

Figure 2:
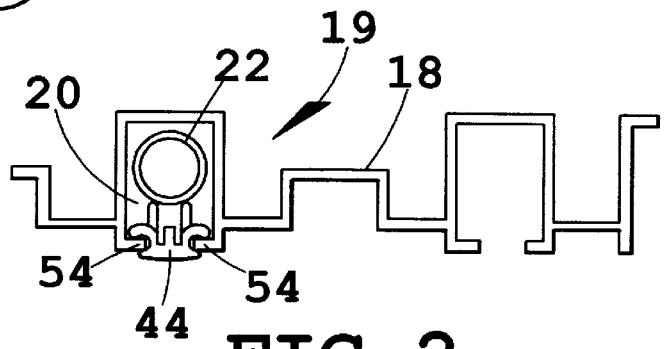
FIG. 2 is a cross-sectional view taken along the plane II—II of FIG. 1.
Figure 3:
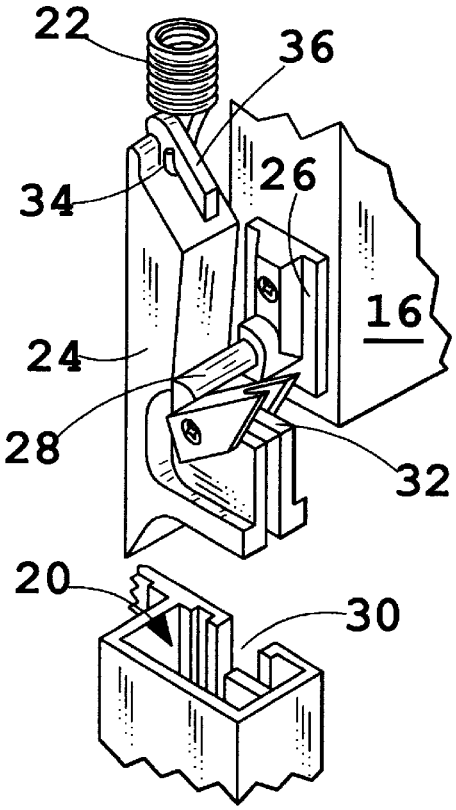
FIG. 3 is a fragmentary perspective view of a friction shoe which can be used as a sash support member for connecting an end of the spring to the sash.

Mounted on each of the jambs 12 and 13 is a jamb liner assembly 19, which is shown in cross section in FIG. 2. Jamb liner assemblies 19 include a jamb liner 18 and extend vertically along the entire height of the window opening along the jambs 12 and 13 from the bottom horizontal member 15 to the top horizontal member 14. Jamb liners 18 are conventionally extruded from plastic such as PVC and have a constant cross-sectional shape or profile. As shown in FIG. 2, jamb liner 18 defines a vertically extending channel 20. Channel 20 extends along the entire length of the jamb liner from the bottom horizontal member 15 to the top horizontal member 14. Channel 20 is associated with sash 16 (the sash nearer the indoor side of the window). Specifically, channel 20, and a substantially identical channel defined by a mirror image jamb liner located on the opposite jamb (not shown), include a coil tension spring 22 disposed within the channels 20, and which are connected to sash 16 to counter or balance the weight thereof. The connection between the coil tension spring 22 and the sash 16 can be either direct or indirect. For example, one end of the coil tension spring 22 can be connected to the sash itself or to a pin or other such part projecting from or attached to the sash. Alternatively, and more typically, an end of the coil tension spring 22 can be connected to a friction shoe 24 (FIG. 3) or other such member by which the sash 16 can be carried.

With respect to the illustrated embodiment, friction shoe 24 is sized and shaped so that it is retained within and will slide vertically along channel 20. A bracket 26 having a pivot pin 28 is mounted to the sides of the sash facing toward the jambs 13 and jamb liners 18. Pivot pin 28 projects through an open side of or slot 30 in channel 20. Pivot pin 28 projects through the slot or open side 30 of channel 20 and into channel 20 to engage a support surface 32 of friction shoe 24. A first or lower end of coil tension spring 22 includes a hook shaped portion 34 which is used to connect the first end of the spring to a hook portion 36 of friction shoe 24. A second, opposite or upper end of spring 22 is connected to a portion of the frame 12 or to jamb liners 18. Coil tension spring 22 is generally stretched irrespective of the position of sash 16, and is resiliently biased such that it will contract if the weight of the sash 16 is removed. Therefore, spring 22 urges sash 16 upwardly. Desirably, the magnitude of the upward forces exerted on the sash by the spring is approximately equal to, and thus balances, the weight of the sash.

Figure 4:
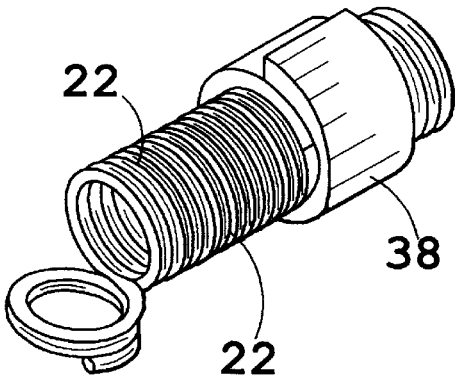
FIG. 4 is a fragmentary perspective view of a coil spring with a soundproofing strip wrapped around and attached to radially outwardly facing surfaces of the coil spring.

As shown in FIG. 4, at least one strip 38 of sound-absorbent material is wrapped around a portion of spring 22, and is attached thereto. The strip 38 is generally wrapped circumferentially around the spring. It is preferred that the strip 38 completely circumscribes a portion of the spring. Accordingly, the length of the strip should be at least about equal to the circumference of the spring, so that the strip forms a substantially continuous band around the spring. The width of the strip 38 should be sufficient to provide the desired sound-damping effect. For this reason, the strip should have a width which is at least greater than the thickness of a single winding or turn of the spring. A suitable width of the strip is about equal to the diameter of the spring.

Relatively thick fabrics are preferred for forming the strip 38, although soft resilient polymerics and the like may also be used. Suitable fabrics include those having a thickness of at least about 1/32 inch, and preferably two or three times that thickness, as determined when the fabric is not compressed. Non-woven fabrics are preferred. A material which is presently preferred is felt.

Figure 5:
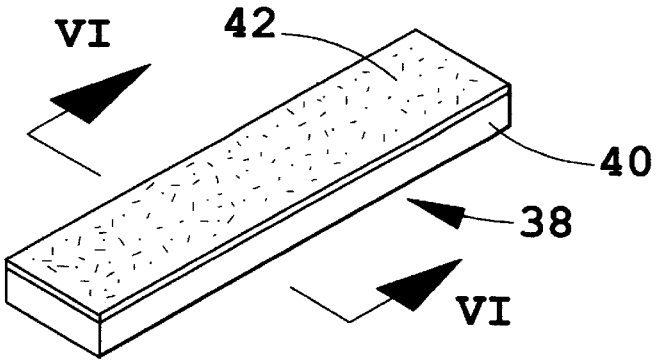
FIG. 5 is a perspective view of a strip as shown in FIG. 4, before it is wrapped around the coil spring.
Figure 6:
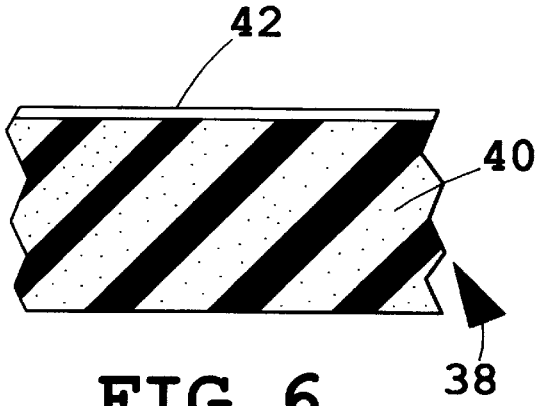
FIG. 6 is a cross-sectional view taken along the plane VI—VI of FIG. 5.

As shown in FIGS. 5 and 6, fabric strip 38 may be comprised of a relatively thick layer 40 of non-woven fibers, and a relatively thin film 42 of adhesive material, such as a contact adhesive. Adhesive film 42 is usually covered by a protective sheet of liner material which must be stripped off before applying the fabric strip 38. Another suitable technique for attaching a strip of material which does not have an integral adhesive film is to apply the adhesive directly to the spring at the point over which the fabric material is to be attached, and then wrap the fabric around the adhesive and spring. Alternatively, other adhesives, cements or the like may be applied to either or both of the spring 22 and strip 38 before contacting and wrapping the strip around the spring. Pre-coated tape-like fabric is preferred, however.

It has been found that it is possible to attach the strip 38 to spring 22 with adhesives while the spring 22 is in a relaxed or non-tensioned state. Tension can subsequently and repeatedly be applied to spring 22, stretch the length of spring 22, and allow it to recoil to its non-tensioned length, without causing the strip 38 to become detached from spring 22. The strip 38 remains attached even when it is initially attached with adhesives to a plurality of abutting windings which become separated when the spring 22 is stretched. This depends primarily on the characteristics of the material forming strip 38, since elastomers will stretch and contract with the spring 22 while felt or the like will allow sufficient movement of its surface fibers to accommodate the expansion. It is therefore believed that normal use of the window 10 will not cause strip 38 to become detached from the spring. Although strip 38 may separate from some of the windings of the spring 22 to which it is initially secured with an adhesive, it should continue to adhere to at least one of the windings even after repeated use. Also, the individual fibers of the preferred non-woven fabric materials will tend to shift as the spring 22 is subjected to tension and adjacent windings are separated. However, the fibers will not become completely separated from the non-woven fabric mat 40 or from the windings. Accordingly, with non-woven materials, such as felt, permanent attachment with adhesives can be achieved at a plurality of individual adjacent windings of the spring 22.

As shown in FIG. 2, a spring cover 44 may be connected to channel 20 to cover the opening or slot 30 in channel 20 to completely enclose spring 22 therein. It will be readily appreciated by those having ordinary skill in the art that in the case of a typical window having a vertically slidable sash, such as shown in FIG. 1, spring 22 can be completely concealed and enclosed by spring cover 44 over a substantial portion of its length. Spring cover 44 extends vertically from top horizontal member 14 downwardly to an elevation about equal with or slightly below, the upper edge of sash 16 when sash 16 is in the fully lowered position. It is important that the spring cover 44 does not extend downwardly past the location of pivot pin 28, or any other means for connecting sash 16 to spring 22, when sash 16 is in the fully raised position. In other words, it is important that spring cover 44 does not extend significantly past the elevational center line of the window 10, so that the spring cover will not interfere with raising or lowering of the sash.

While the provision of a spring cover alone will provide a sound-deadening barrier which will help reduce objectionable noises generated by interactions between spring 22 and the jamb liners 18 as sash 16 is raised or lowered, it is preferred that the spring cover be used in combination with the strips 38 wrapped lengthwise around spring 22.

Figure 7:
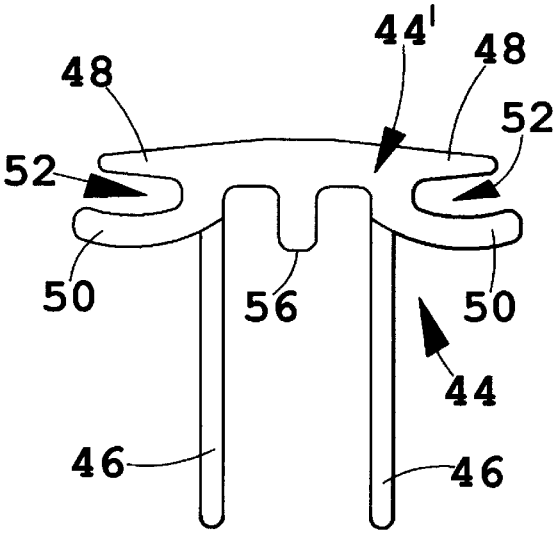
FIG. 7 is an enlarged transverse, cross-sectional view of a soundproofing spring cover adapted to be connected to and close a channel defined by a jamb liner.

FIG. 7 shows an enlarged cross-sectional view of a preferred new form of spring channel cover 44, having a pair of flexible walls 46 which project from one side of the channel cover into channel 20 and into engagement with spring 22, as generally shown in FIG. 2. Engagement between flexible walls 46 and spring 22 tends to damp and minimize spring vibration and also minimize the amount of contact between the spring and the walls of channel 20, thereby reducing or eliminating undesirable and objectionable noises generated by the spring as sash 16 is raised or lowered. As indicated in FIG. 7, spring cover 44 is provided with outer and inner engagement lips, 48 and 50 on each side which define vertical grooves 52 on opposite sides of spring cover 44. Edges of walls 54 defining slot 30 in jamb liner 18 are received in grooves 52. A longitudinal stiffening and reinforcing rib 56 extending along the length of cover 44 and disposed between the lips 50, on the inwardly-facing side, is preferably included but is not essential in a strict sense.

Spring cover 44 is preferably made of a somewhat flexible plastic material, such as polyvinyl chloride, and is preferably formed as an integral member by extrusion. In its most preferred form, the body 44' of cover 44 is somewhat stiffer than the flexible walls 46, which can be relatively thin in cross section and can also be (and preferably are) formed from a different and more elastomeric material, e.g., "Estane" (a trademark of B. F. Goodrich Chemical Group, Breaksville, Ohio). "Estane" is a thermoplastic polyester or polyurethane elastomer which is extremely tough and abrasion resistant, and which can be co-extruded with the body portion 44'. Spring cover 44 can be installed on jamb liners 18 by placing jamb liner 18 and spring cover 44 in end-to-end relationship with the grooves 52 aligned with the edges of walls 54, and sliding the spring cover with respect to channel 18 to engage the edges of walls 54 in grooves 52.

Figure 8:
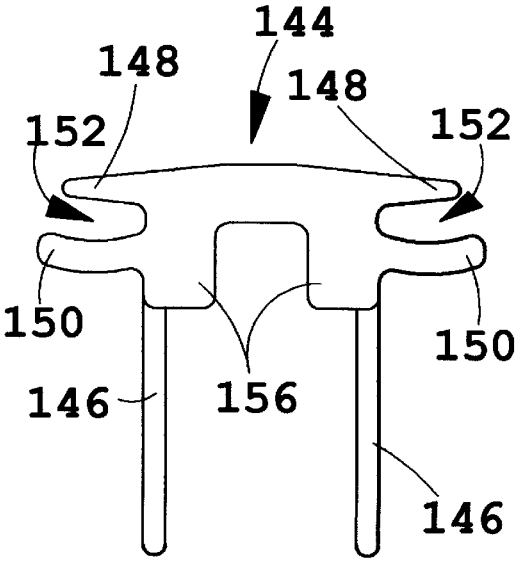
FIG. 8 is a cross-sectional view like FIG. 7 but showing an alternative embodiment of the corresponding structure which provides certain other advantages.

FIG. 8 illustrates a variation 144 of the spring cover 44 described above, having essentially the same overall structure (denoted by use of the same numbers for corresponding elements or portions, preceded by the number "1") but including thicker and more inwardly-protruding inside portions 156 extending longitudinally of the cover and (optionally) omitting the stiffening rib 56. The thicker portions 156 not only serve to stiffen the overall cover structure but in addition provide the added advantage of serving as a stop or abutment which will prevent the inadvertent upward movement of a friction shoe or positioner 24, such as that shown in FIG. 3, into the inside of the channel or spring recess 20 in response to tension forces acting on spring 22, as may for example occur if for any reason the tilt lock mechanism used in a given product or configuration happens to malfunction and release the spring tension when the sash is tilted and/or removed from the jamb liners. To some extent, this same advantage may be obtained by appropriately configuring the rib 56 of the FIG. 7 embodiment, or even by combining the FIG. 7 and FIG. 8 embodiments. It should be understood that this is equally applicable to all or most forms of balances or positioners, including, for example, those shown in prior U.S. Pat. Nos. 4,015,367, 4,570,382, 4,887,389, 5,036,622, etc. As will be understood, this advantage is provided in each case by simply configuring the portions 156 (and/or the rib 56) to provide an occlusion at the lower end of cover 44. Such an occlusion will block the spring channel opening sufficiently to stop passage of the positioner "shoe" into it, and preferably prevent jamming therebetween as well, in the event the spring is released and thereby able to abruptly pull the positioner upward within the spring channel toward cover 44.

It will be apparent to those skilled in the art that various modifications to the preferred embodiment of the invention as described herein can be made without departing from the spirit or scope of the invention as defined by the appended claims.

The invention claimed is:

1. A sound-reduction arrangement for a window having a sash of the type mounted for sliding vertical movement between jabs of a window case and employing a spring balance mechanism, comprising:

first and second jamb liners adapted to be mounted on opposite jambs of the window case, each of said jamb liners defining a vertically extending channel having an open side facing away from the jambs;

a coil spring disposed within said vertical channels, each coil spring adapted to be connected at one end to the window case and at an opposite end to the sash; and a spring cover having a portion connected to and closing a vertically extending portion of said open side of each of said vertically extending channels, said spring cover including at least one flexible portion projecting laterally therefrom into said channel and engaging the spring to quiet sounds caused by vibration of said spring during said window movement.

2. The sound-reduction arrangement of claim 1, wherein said flexible portion of said spring cover comprises an elongated wall element extending lengthwise of said spring cover and projecting toward the spring from the portion covering the channel.

3. The sound-reduction arrangement of claim 2, wherein said flexible portion of said spring cover is thinner in section and more flexible than said portion thereof connected to and closing said open side of said channel.

4. The sound-reduction arrangement of claim 2, wherein said flexible portion of said spring cover is comprised of a different material than said portion thereof connected to and closing said open side of said channel.

5. The sound-reduction arrangement of claim 4, wherein said flexible portion of said spring cover and said portion thereof connected to and closing said open side of said channel comprises a co-extruded member.

6. The sound-reduction arrangement of claim 5, wherein said flexible portion comprises a soft, yieldable polymeric material.

7. The sound-reduction arrangement of claim 6, wherein said portion of said spring cover connected to and closing said open side of said channel is comprised of relatively hard and rigid polymeric material such as rigid PVC.

8. A sound-reduction spring cover for use in a window assembly of the type having an elongated spring disposed within an elongated recess in a window jamb liner having a frontal opening and connected to a window sash to help carry the weight of the window sash, said cover comprising an elongated member having a primary portion adapted to fit over and cover the frontal opening and further having a secondary portion comprising at least one flexible fin member extending laterally from said primary portion through said frontal opening and into contact with the spring within said recess to help damp vibration of the spring during deflection thereof due to movement of the window sash along the jamb liner.

9. A jamb liner assembly for a window of the type having a sash mounted for sliding vertical movement between jambs of a window case, comprising:

a jamb liner for mounting a jamb of the window case, said jamb liner defining a vertically extending channel having an open side oriented to face away from the jamb;

a coil spring disposed within said vertical channel, said coil spring fixed at one end with respect to said jamb liner, and free at an opposite end;

at least one discrete elongated length of sound-absorbent material attached to and extending at least partially around the outer circumference of each of said coil springs; and a spring cover connected to and at least partially closing a vertically extending portion of said open side of said vertically extending channel said spring cover including at least one flexible wall projecting laterally therefrom into said channel, at least a portion of said at least one flexible wall engaging said spring to quiet sound caused by spring vibration during said sash movement.

* * * * *

UNITED STATES PATENT AND TRADEMARK OFFICE

CERTIFICATE OF CORRECTION

PATENT NO. : 6,148,562
DATED : November 21, 2000
INVENTOR(S) : Ivan L. Stark et al.

It is certified that error appears in the above-identified patent and that said Letters Patent is hereby corrected as shown below:

Abstract,
Line 18, "fin walls" should be -- fin-like walls --.

Column 6, claim 1,
Line 31, "open side" should be -- opening in a side --.

Signed and Sealed this

Sixth Day of November, 2001

*Attest:*

Nicholas P. Godici

NICHOLAS P. GODICI
*Acting Director of the United States Patent and Trademark Office*

*Attesting Officer*